US005305421A

United States Patent [19]

Li

[11] Patent Number: 5,305,421

[45] Date of Patent: Apr. 19, 1994

[54] LOW BIT RATE SPEECH CODING SYSTEM AND COMPRESSION

[75] Inventor: Kung-Pu Li, La Jolla, Calif.

[73] Assignee: ITT Corporation, New York, N.Y.

[21] Appl. No.: 750,981

[22] Filed: Aug. 28, 1991

[51] Int. Cl.[5] ..... G10L 9/02

[52] U.S. Cl. ..... 395/2.28; 395/2.71

[58] Field of Search ..... 381/29-53; 395/2.77, 2.16, 2.47, 2.28, 2.71

[56] References Cited

U.S. PATENT DOCUMENTS 4,720,863 1/1988 Li et al. ..... 381/42
4,975,956 12/1990 Liu et al. ..... 381/36
4,975,957 12/1990 Ichikawa et al. ..... 381/36

*Primary Examiner*—Michael R. Fleming
*Assistant Examiner*—Michelle Doerrler
*Attorney, Agent, or Firm*—Arthur L. Plevy; Patrick M. Hogan

[57] ABSTRACT

A speech coder apparatus operates to compress speech signals to a low bit rate. The apparatus includes a continuous speech recognizer (CSR) which has a memory for storing templates. Input speech is processed by the CSR where information in the speech is compared against the templates to provide an output digital signal indicative of recognized words, which signal is transmitted along a first path. There is further included a front end processor which is also responsive to the input speech signal for providing output digitized speech samples during a given frame interval. A side information encoder circuit responds to the output from the front end processor to provide at the output of the encoder a parameter signal indicative of the value of the pitch and word duration for each word as recognized by the CSR unit. The output of the encoder is transmitted as a second signal. There is a receiver which includes a synthesizer responsive to the first and second transmitted signals for providing an output synthesized signal for each recognized word where the pitch, duration and amplitude of the synthesized signal is changed according to the parameter signal to preserve the quality of the synthesized speech.

34 Claims, 4 Drawing Sheets

LOW BIT RATE SPEECH CODING SYSTEM AND COMPRESSION

The United States Government has rights in this invention pursuant to RADC Contract F30602-89-C-0118 awarded by the Department of the Air Force.

FIELD OF THE INVENTION

The present invention relates to a speech coder which operates at low bit rates and, more particularly, to a speech coder which employs apparatus to dynamically control and change word duration, pitch value and amplitude of stored words to obtain improved synthesized speech signals which can be transmitted and received at low bit rates.

BACKGROUND OF THE INVENTION

An effective, low bit rate speech coder should have the characteristics of high speech intelligibility, speaker independence, ease of real time implementation and short throughput delay. To maintain low bit rate transmission and simultaneously achieve these goals is conventionally considered contradictory.

Various speech encoding algorithms and techniques have been proposed for encoding and decoding low data rate speech parameters from and to speech signals. Techniques for vector quantization of line spectrum pairs (LSP) data converted from standard linear predictive coding (LPC) parameters derived from input speech signals has been suggested, for example, in "Application of Line-Spectrum Pairs to Low Bit Rate Speech Encoders" by G. S. Kang and L. J. Fransen, Naval Research Laboratory, at Proceedings ICASSP, 1985, Pages 244–247. A tree encoding technique using adaptive or time varying quantization was disclosed by N. S. Jayant and S. A. Christensen, Bell Laboratories at IEEE Transactions on Communications, COM-26, September 1978, Pages 1376–1379. For transmitted speech signals encoded by vector quantization an improvement in decoding performance at the receiver end by optimization of the codebook for decoding words from the incoming signals has been disclosed in the prior art. See an article entitled "Improving the Codebook Design for Vector Quantization" by Y. J. Liu, ITT Defense Communication Division at Proceedings IEEE Military Communications, 1987, Pages 556–559. See also U.S. Pat. No. 4,975,956 and U.S. Pat. No. 5,012,518 both entitled LOW-BIT RATE SPEECH CODER USING LPC DATA REDUCTION PROCESSING issued on Dec. 4, 1990 and Apr. 30, 1991, respectively to Y. J. Liu et al. and assigned to the assignee herein. For more detail in regard to speech recognition systems, reference is also made to the following materials which are incorporated herein: "Keyword Recognition Using Template Concatenation", by A. L. Higgins and R. E. Wohlford, 1985 ICASSP; "Speaker Recognition by Template Matching", by A. L. Higgins, Proceedings of Speech Technology 1986, New York, N.Y.; "Improved Speech Recognition in Noise", by B. P. Landell, R. E. Wohlford, and L. G. Bahler, 1986 ICASSP, vol. 1, no. 1; U.S. Pat. No. 4,720,863 issued Jan. 19, 1988 to K. P. Li and E. H. Wrench; and copending U.S. patent application No. 346,054, filed on May 2, 1989, by B. P. Landell et al., entitled "Automatic Speech Recognition System Using Seed Templates", now U.S. Pat. No. 4,994,983.

As one can ascertain, many of the prior art proposals do not provide high intelligibility and reliability at low data rates. This is particularly true for speech independent speech coding in communications over high frequency channels in difficult environments.

Thus, it is an object to provide an improved speech compression system which circumvents the problems in the prior art.

It is a further object to provide a speech compression system which operates at 50 bits per second (BPS) and hence is capable of extremely low frequency operation with improved reliability and intelligibility.

SUMMARY OF THE INVENTION

A speech coder apparatus for encoding input speech signals for transmission over a communication channel at low bit rates, comprising transmitting means responsive to an input speech signal for providing a first and a second output signal for transmission, said transmitting means including continuous speech recognition means having a memory for storing templates and means responsive to said stored templates to provide at an output digital signals indicative of recognized words in said input speech as those matching said stored templates with said one output providing said first output signal and providing at a second output a word end point signal; and said transmitting means including front end processing means responsive to said input speech signal for providing at an output digitized speech samples during a given frame interval including side information encoding means having an input coupled to said second output of said continuous speech recognition means to provide at an output a signal indicative of at least the value of the pitch and duration for each word recognized by said continuous speech recognition means with said output providing said second output signal for transmission. The system enables one to implement the change of pitch, speaking rate and amplitude at the synthesizer which is part of the invention.

DETAILED DESCRIPTION OF THE FIGURES

Figure 1:
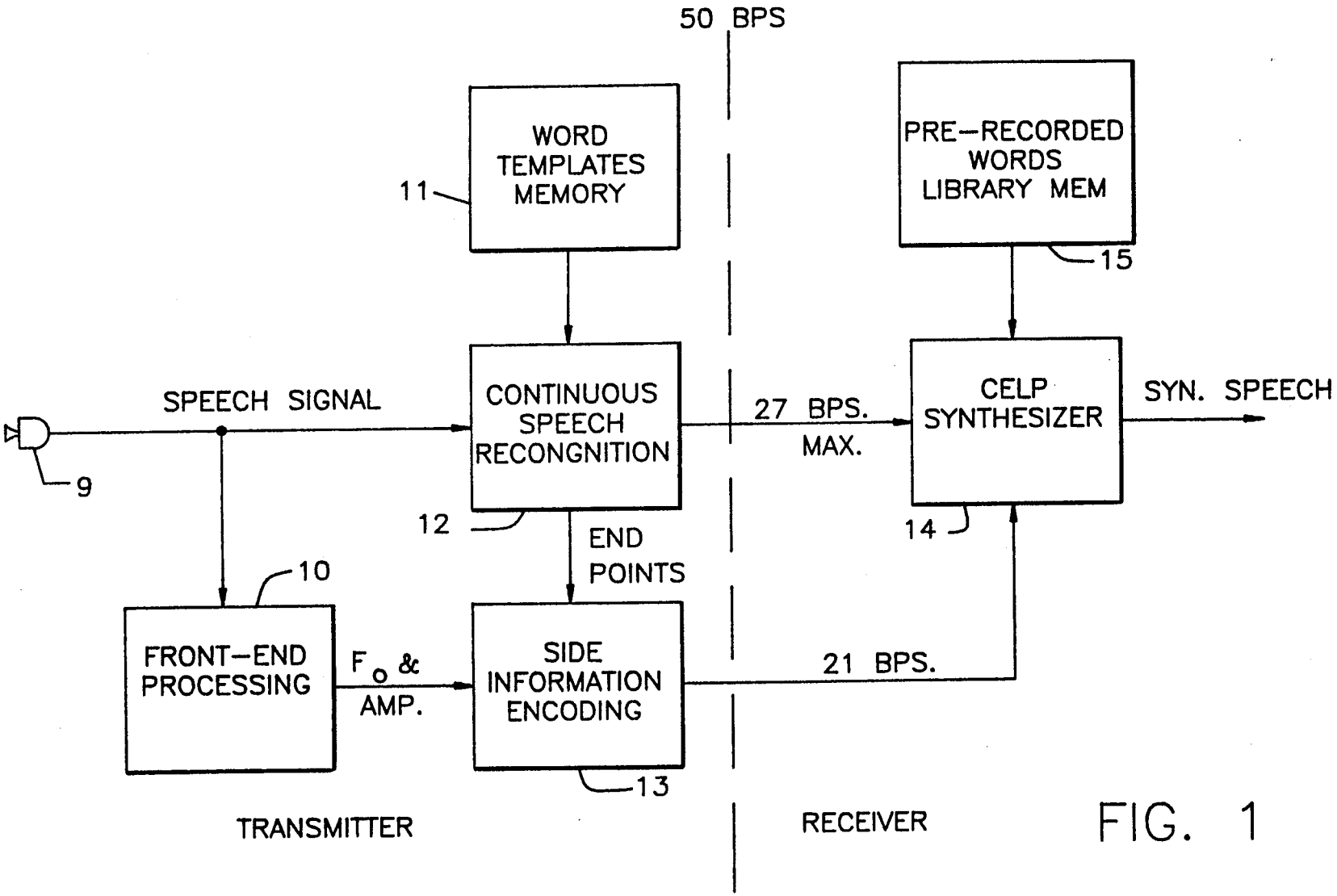
FIG. 1 is a block diagram of a 50 BPS speech compression system according to this invention.

Referring to FIG. 1, there is shown a block diagram of a 50 BPS speech coding system according to this invention. As seen, input speech from a microphone or other source 9 is applied to the input of a front end processing module 10. The microphone 9 may include suitable filters and amplifiers (not shown). As will be explained, the front end processing module may include a microprocessor and operates to process the input speech in regard to pitch, duration and amplitude values. Simultaneously with applying the speech signal from the microphone to the front end processing module 10, the signal is also applied to the input of a continuous speech recognition (CSR) module 12. The continuous speech recognition module (CSR) 12 is well known in the art. Such a system matches the phrase or incoming speech using stored template sets. The templates are basically stored in memory and may be derived from units smaller than or the same as words, such as acoustic segments of phonemic duration. In this way it is possible to cover a short test utterance using templates extracted from a short training utterance. Essentially, such systems derive a set of short, sub-word templates from each user's training material and attempts to match the test utterance with each template set using a CSR system. Such systems are extremely well known. See, for example, U.S. Pat. No. 4,773,093 entitled TEXT INDEPENDENT SPEAKER RECOGNITION SYSTEM AND METHOD BASED ON ACOUSTIC SEGMENT MATCHING issued on Sep. 20, 1988 to A. L. Higgins et al. and assigned to the assignee herein. Essentially, the templates employed herein are at the word template level as employed in U.S. Pat. No. 4,994,983 indicated above. This patent shows the basic configuration for a CSR in FIG. 1 and shows how templates are generated for such systems. Basically, speech is provided to the CSR input which includes an acoustic analyzer for dividing speech into short frames and can provide a parametric output of each frame. The parametric output is used by the CSR to match a test utterance to the stored templates and provides a match score for each speaker. Essentially, as will be explained, the CSR 12 operates with template based matching using the dynamic time warping (DTW) algorithm. The particular algorithm used is not important and others can be used as well. The DTW pattern matching algorithm matches unknown speech data with the speakers reference templates. Basically, the utilization of the DTW algorithm is well known. See copending application entitled DYNAMIC TIME WARPING (DTW) APPARATUS FOR USE IN SPEECH RECOGNITION SYSTEMS, by G. Vensko et al., filed on Jun. 8, 1989, S.N. 07/363,227, and assigned to the assignee herein. The CSR unit 12 is based on template based matching using the DTW algorithm. The templates associated with each speaker are stored in the word template memory 11. The speaker dependent templates contain word, filler, and silence templates generated by conventional techniques. The 4,773,093 patent describes a continuous speech recognition system (CSR) to match the recognition utterance with each speaker's template set in turn. Thus, the use of templates are well known. See also U.S. Pat. No. 5,036,539 entitled REAL-TIME SPEECH PROCESSING DEVELOPMENT SYSTEM by E. H. Wrench and A. L. Higgins, issued on Jul. 30, 1991 and assigned to the ITT Corporation, the assignee herein.

The parameters used are 8 cepstra (4 bit accuracy) derived from the normalized filter bank values in the CSR 12. Essentially, the CSR 12 operates to process speech and further provides end points in frame number of every word (including pauses between words) in the recognized speech. These word end-points are part of the side information generated by the encoding module 13. The side information encoding module 13 also receives an input from the front end processing module 10. The output from the continuous speech recognition module 12, which is at a maximum of 27 bits per second, is applied to an input of a CELP synthesizer 14. The CELP synthesizer 14 also receives the side information encoding from module 13 at a 21 bit per second rate. The synthesizer is associated with a large memory 15 which has stored therein pre-recorded words. The output of the synthesizer is synthesized speech. The memory 15 is a word library memory and has stored therein the pitch, duration and amplitude for every library word. Essentially, as seen from FIG. 1, the entire system is a 50 bit per second speech compression system, and includes the transmitting portion which includes the front end processing module 10, the side information encoding module 13, the CSR 12 and the CSR memory 11. A first output of the CSR 12 transmits the recognized word data to the receiver on a first path at a maximum rate of 27 BPS. The output from the side information encoding module 13 is transmitted on a second path to the receiver at a 21 BPS rate. The term "transmission" is used as the path can be wire paths or alternatively radio or other communications channels. The receiving end includes the CELP synthesizer 14 and the pre-recorded word or library memory 15. As one can see from FIG. 1, the transmitter and receiver sections are divided by the dashed line which is referenced by the 50 BPS transmission rate.

The front end processing module 10 and the side information encoding module 13 perform a CELP analyzer function, as will be described.

The parameters used are 8 cepstra derived from the normalized filter banks. The sequence of words is controlled by a syntax control table (not shown). In this manner the system accepts only the utterances which are valid within the syntax restrictions. The syntax specifies the possible connections of any and all vocabulary words. The system tracks background noise, rejecting out of vocabulary words and adapting templates with estimated background noise. This template adaptation to background noise is called template adjustment. The system shows an analog input speech signal where an analog to digital converter is used in the CSR 12 to convert analog speech signals into digital samples using a sampling rate of 8KHz. However, the system can directly process digital parameters such as line spectrum pair (LSP) data or linear predictive coding (LPC) data.

The CSR 12 recognizes sentences or recognizes words by comparing them with data stored in the word template memory 11 and also provides the end points in frame number of every word (including pauses between words) in the recognized sentence. These word end points are part of the side information which is used by the side information encoding module 13 for extracting the pitch, the amplitude, and the duration of words. This occurs based on an algorithm which will be described. The system provides compression and the transmission operates mainly with the CSR 12 while the analysis and synthesis receiver is implemented by the CELP synthesizer 14. Basically, the CELP synthesizer 14 is a well known system and is designated under the designation as FED-STD-1016. A typical CELP synthesizer is described in an article entitled "An Expandable Error-Protected 4800 BPS CELP Coder", published in the proceedings of ICASSP, Vol, ICASSP-89, Page 735–738 by J. P. Campbell, Jr., V. C. Welch and T. E. Tremain, U.S. FED-STD-4800 BPS voice coder (1989).

The analyzer of the CELP synthesizer 14 serves as the front end processing module 10 and in this manner coordinates the word end points from the CSR 12 to estimate the median value of pitch, duration, and amplitude for every word. These values are compared with those of the word in the synthesizer library by means of the CELP synthesizer 14. The programming of the synthesizer to operate as the front end processing 10 and side information encoding 13 is an important aspect of this system. Then the necessary changes for synthesis are encoded. The possible changes are three levels of pitch value, three levels of word duration, three levels of word amplitude, and five values of pitch slope changes in time. Since not all possible change combinations are used, they require an average of 7 bits/word. Therefore, the average rate emanating from the side information encoding module 13 is about 21 BPS. The CELP synthesizer 14 processes the side encoded parameters from files stored in the word library memory 15. The synthesizer 14 then uses the encoded side information from module 13 to change the pitch, duration, and amplitude of the pre-recorded words or library words 15.

Figure 2:
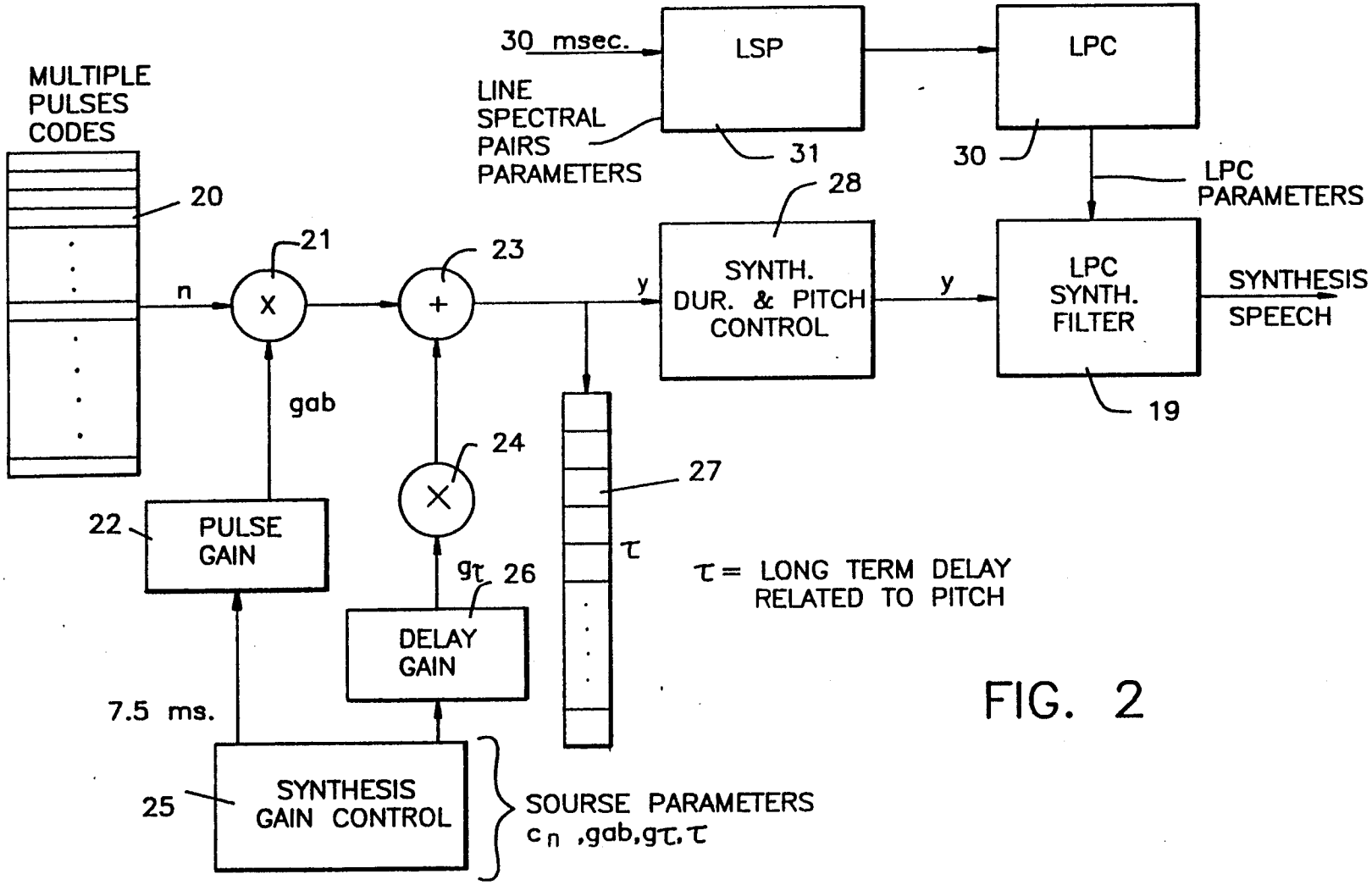
FIG. 2 is a block diagram of a speech synthesizer employing side information according to this invention.

Referring to FIG. 2, there is shown a block diagram indicating the major functions of synthesis processing with side information controls. Basically, a frame (30 msec.) of word samples which are derived from the CSR 12 are applied to a line spectrum pair or LSP module 31. The LSP module 31 has an output directed to a linear predictive coding or LPC module 30. The LPC module 30 operates to digitize and process the input speech samples into suitable coefficients. LSP conversion techniques are well known, for example, as described in "Application of Line Spectrum Pairs to Low Bit Rate Speech Encoders" by G. S. Kang and L. J. Fransen, Naval Research Laboratory at Proceedings ICASSP, 1985, Pages 244–247. The LSP output of module 31 is applied to the input of an LPC module 30. As indicated, LPC module 30 digitizes and processes the output from the LSP module 31 and applies the processed signals to the input of an LPC synthesizer filter 19. Basically, the roots for the LSP data are computed using a fast algorithm which may be an FFT algorithm. The LPC synthesizer filter 19 may include a sum and a difference filter. The roots of the sum filter and the difference filter form line spectrum frequencies (LSFS). Such techniques, as indicated, are well known. The output of the LPC filter 19 is the synthesized speech. The response of the filter is modified for each word by the side information parameters generated by module 13 and received by CELP synthesizer 14. The side information encoding is manifested by the multiple pulse codes stored in register 20, whereby the output is designated by the letter n. The letter n is used to indicate that there is a pulse code for each of N words in a frame. This output or multiple pulse code from register 20 is applied to one input of a multiplier 21 which receives at its other input a pulse gain factor designated as $g_{ab}$. The output of the multiplier 21 is applied to an adder 23. The output of the adder 23 is applied to the input of a synthesizer duration and pitch control module 28. The output y of the module 28 is applied to one input of the LPC synthesizer filter 19. Thus the filter 19 is controlled according to the output from the synthesizer duration and pitch control module 28.

As seen, the output of the adder 23 is also applied to a delay register or delay line 27 which provides a sample delay (t), as will be explained. The output of the delay register 27 is applied to one input of a multiplier 24 whose output is applied to the other input of the adder 23. The multiplier 24 receives an input from a delay gain module 26 which is coupled to one output of the synthesis gain control module 25. As seen, the synthesis gain control module 25 has one output coupled to a pulse gain module 22 whose output, as indicated, is coupled to one input of multiplier 21. The other output from the synthesizer gain control module 25 is coupled to the input of a delay gain module 26. The output of module 26 is coupled to the other input of multiplier 24. As seen in FIG. 2, the output from the pulse gain module 22 is designated $g_{ab}$. The output from the delay gain module 26 is designated as $g_T$. The input to the synthesizer duration and pitch control module is designated as y' while the output is designated as y. The output from the multiple pulse codes module 20 is designated as n.

Thus, as seen in FIG. 2, the excitation function is generated from four coded parameters ( $_T$, $g_T$, $g_{ab}$, n) The modification of pitch and duration must be processed after the generation of the excitation function. The synthesis of the excitation signal is implemented every subframe (60 samples) and 4 subframes form a 30 millisecond frame containing 240 samples for each set of LPC parameters. This is indicated by the 30 millisecond (msec.) input to the LSP module 31. Frame generation associated with speech processing systems is extremely well known. Basically, in any such system, incoming speech as from microphone 9 of FIG. 1 is sampled by conventional sample and hold circuitry operating with a given sample clock. The output of the sample and hold circuitry is then analog to digital (A/D) converted by a typical A/D converter to produce pulse code modulated (PCM) signal samples. These samples are then processed by means of the front end processing module 10 and the CSR 12 where they are converted into frames of speech data. This is done by taking sequential PCM samples and using well known linear predictive coding (LPC) techniques to model the human vocal tract converting these samples into an LPC n coefficient frame of speech. See an article entitled "Linear Prediction: A Tutorial Review" by J. Makhoul, Proceedings of IEEE, April 1975, Vol. 63 No. 4, Pages 561–580 and "Linear Prediction of Speech" by J. P. Markel and A. H. Gray, Jr., Springer Verbg, 1976. Then, taking the last number of samples in time from the first conversion and combining that with the next number of samples in time, a new LPC frame is formed. Each frame is a point in a multi-dimensional speaker space which is a speaker space which models the speaker's vocal tract. Thus, such techniques are well known. See U.S. Pat. No. 4,720,863 issued on Jan. 19, 1988 and entitled METHOD AND APPARATUS FOR TEXT-INDEPENDENT SPEAKER RECOGNITION by K. P. Li et al. and assigned to the assignee herein. This patent gives a detailed review of LPC techniques including programs and samples for generating LPC coefficients. See also U.S. Pat. No. 5,036,539 entitled REAL TIME SPEECH PROCESSING DEVELOPMENT SYSTEM by E. H. Wrench, Jr. et al. issued on Jul. 30, 1991 and assigned to ITT Corporation, the assignee herein.

The pitch change is accomplished by Lagrange interpolation of each frame of data into a different number of samples, and duration change is accomplished by inserting or deleting groups of samples whose length is the same as the long-term delay, $_T$. The Lagrange interpolation form is well known and widely employed in the process of interpolation. Thus the Lagrangian form replaces linear interpolation by providing greater accuracy and employs a polynomial of degree n. Another form of the interpolating polynomial which is also used is the "Newton Divided Difference Polynomial". Interpolation is discussed in many texts, see "A First Course in Numerical Analysis", 2nd Edition, by A. Ralston and P. Rabinowitz, (1978) McGraw-Hill, New York. See also "Error Analysis of Floating Point Computations" by J. H. Wilkinson published in Num. Math., vol. 2, pages 319-340 (1960). For example, if the pitch frequency needs to be increased (or decreased) by 20% to $\tau_{new}$, then every frame of 240 samples is interpolated into 192 (or 288) samples. These samples are placed behind any remaining samples from the previous frame. If the duration needs to be increased (or decreased) by 20%, then at each subframe boundary the quantity $\tau_{new}$ is repeated or deleted in samples until the total number of samples of the frame is just more than 288 (or 192) samples. Then the synthesis is applied to the first 288 (or 192) samples through the LPC inverse or difference filters, and the remaining samples are kept for the beginning of the next frame. The change of pitch slope is done by changing the pitch by a variable percentage on each frame. The amplitude is changed by multiplying excitation function by a scale factor $g_{ab}$ before the synthesis. This is accomplished by means of the synthesis gain control 25 and the pulse gain module 22 with multiplier 21. After the process, each frame contains a different number of samples; however, the playback synthesized speech from the output of the LPC synthesizer filter 19 remains at a 8KHz sampling rate.

By the utilization of the above technique, very little degradation of the synthesized speech occurs. Basically, most of the above-described techniques have been programmed in a non real time C language program. The CSR 12 which is shown in FIG. 1 has been implemented employing the VRS-1280 real time single board speech recognizer employing the DTW-II firmware to perform continuous speech recognition. As indicated the CSR is based on template base matching with a dynamic time warping (DTW) algorithm.

Figure 3:
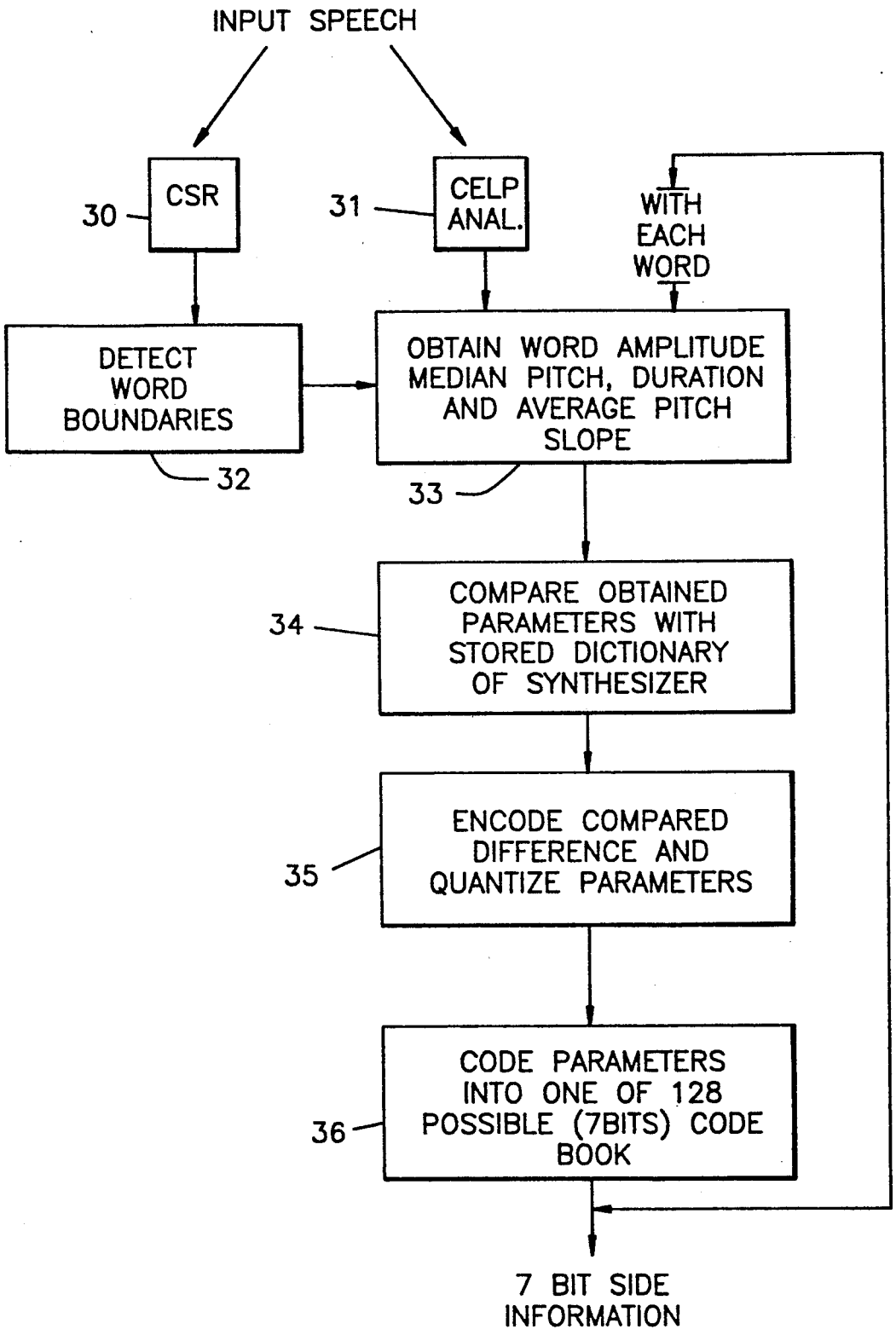
FIG. 3 is a flow chart of the 50 BPS transmitter section of the side information capability according to this invention

Referring to FIG. 3, there is shown a flow chart depicting the operation of the 50 BPS transmitter section shown in FIG. 1 to the left of the dashed line to obtain the seven bit side information. As shown in FIG. 1, input speech from microphone 9 is applied to the CSR 50 and to the CELP analyzer 51. The CELP analyzer 51 includes the front end processing module 10 and the side information encoding module 13. The CSR module 50 detects the word boundaries in conventional techniques. This is indicated by module 32. The output or the word boundaries are then applied to module 33 as is the output of the front end processing module 10 as implemented by the CELP analyzer section. Thus, one now obtains the word amplitude, the median pitch, the word duration and the average pitch slope of each word. This is designated in module 33. After these parameters are obtained, they are then compared with the stored dictionary parameters or the word template parameters of the CSR system as indicated in module 34. These parameters are quantized as shown in module 35. The quantized parameters are then coded into one of 128 possible codes (7 bits). These codes provide the output from the side information encoding module 13 as seven bit side information. This information is also fed back from module 36 to module 33 within each word, whereby the input to the side information encoding is fed back as shown in the flow chart.

Figure 4:
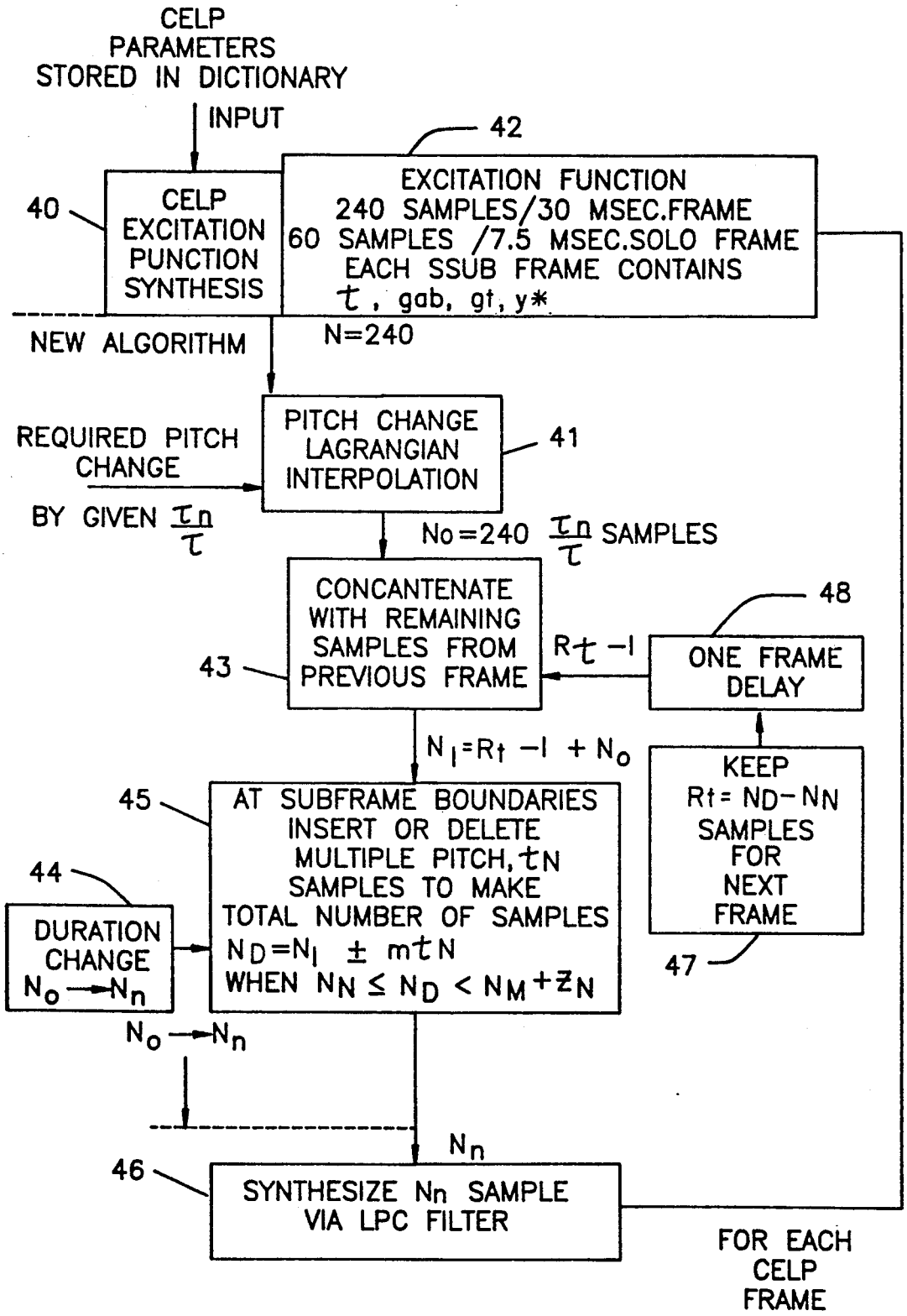
FIG. 4 is a flow chart depicting the change of pitch and the change of duration employed on a CELP synthesizer according to this invention.

Referring to FIG. 4, there is shown a flow chart of the Change pitch and duration programmed in the CELP synthesizer 14 and shown in FIG. 2. The CELP parameters which are stored in the dictionary as prerecorded words via module 15 of FIG. 1, is applied as an input to module 40. Module 40 performs the CELP excitation function synthesis. The excitation function as depicted in module 42 provides 240 samples for a 30 millisecond frame. It also then provides 60 samples for a 7.5 millisecond subframe. There are four subframes in a frame. Each subframe contains $\tau$, $g_\tau$, $g_{ab}$ and y'. The output from the CELP excitation synthesis module 40 is n samples which, in this case, are 240 samples. Each of these samples is subjected to the algorithm which is required to change pitch. The pitch change is accomplished by using the Lagrange interpolation in module 41. This is a well known interpolation form as indicated. The required pitch change is implemented in module 41 as follows. The output from the pitch change module is designated as $N_O$ which is equal to 240 multiplied by tn, divided by t samples. In any event, as indicated above, the pitch frequency can be decreased or increased. Every frame of 240 samples has to be interpolated into a less or a greater number of samples (192 or 288). These samples are placed behind any remaining samples from the previous frame. Thus the output of the pitch change results in a variable number of samples which is applied to module 43. These samples are concatenated with remaining samples from the previous frame as indicated in module 43, where such previous frame samples are stored or applied. The output from module 43 is now designated as $N1=Rt-1+NO$. This, essentially, results in a new number of samples at the output. These new samples are then taken at the subframe boundaries and at the boundaries there is inserted or deleted multiple pitch, tn samples to make the total number of samples $N_D$ equal to $N1 \pm Ntn$ where n is a positive integer when $N_N$ is equal to or less than $N_D$ and when $N_D$ is less than $N_N+Z_N$. The output number of bits designated as $N_N$ are then applied to module 46 which synthesizes the $N_N$ sample via the LPC filter 19, as shown in FIG. 2. This operation is accomplished for each CELP frame. The synthesized sample is fed back into module 40 to again commence the CELP excitation function synthesis for each frame. As also seen, the output of module 45 which results in the $N_N$ bits is applied to the module 47 which, essentially, enables one to keep $R_f=N_D-N_N$ samples for the next frame. Thus this output is applied into a one frame delay module 48 (register 27 of FIG. 2) or it can be stored in memory to enable one to concatenate the new samples from the previous frame as designated by module 43. It is also shown that module 45 interfaces with module 44 which is indicative of the duration change when NO is transformed to $N_N$, as shown. Thus as shown, the apparatus can vary or change the pitch by increasing or decreasing the pitch frequency every frame. An increased or decreased number of samples is provided by interpolating the 240 samples of the frame into a less or a greater number. These samples are then placed behind any remaining samples from the previous frame to provide a new number of samples for each frame, which number may be less than 240 or greater than 240.

Thus, what is shown is a unique method and apparatus to control changes of word duration, pitch value and amplitude to enable one to measure the periodic feature of encoded speech while providing accurate speech compression at lower rates.

The techniques described herein while relating to improved speech compression systems utilizing improved algorithms are applicable to any speech coding system, to voice responsive devices and to reading machines which require variable speed operation. In this manner one can change the speaking rate while obtaining extremely good quality and high reliability speech.

I claim:

1. A speech coder apparatus for encoding input speech signals for transmission over a communication channel at bit rates of 100 bits per second or less, comprising:

transmitting means responsive to an input speech signal for providing a first and a second output signal for transmission, said transmitting means including:

continuous speech recognition means having a first output and a second output, said continuous speech recognition means having a memory for storing templates and means responsive to said stored templates to provide at an output, digital signals indicative of recognized words in said input speech signal as those matching said stored templates with said digital signals providing said first output signal and providing at a second output a word end point signal wherein each of said recognized works in said input speech signal has a value of pitch, duration and amplitude; and front end processing means having an input and an output, said front end processing means responsive to said input speech signal for providing at said output of said front end processing means, digitized speech samples during a given frame interval including side information encoding means responsive to said digitized speech samples and capable of determining value of pitch, duration and amplitude, said side information encoding means having an input coupled to said second output of said continuous speech recognition means and operably responsive thereto, to provide at an output of said side information encoding means a signal indicative of at least the value of the pitch and duration for each word recognized by said continuous speech recognition means with said output of said side information encoding means providing said second output signal for transmission and wherein said side information encoding means includes means for comparing and determining differences of values of said pitch and duration of each recognized word with values of pitch and duration as stored in a memory associated therewith to provide an output parameter signal indicative of said differences.

2. The speech coder apparatus according to claim 1, wherein said continuous speech recognition means employs a dynamic time warping (DTW) algorithm to determine the best match being a word contained in signal with at least one of said stored templates.

3. The speech coder apparatus according to claim 1, wherein said stored templates include word, filler and silence templates.

4. The apparatus according to claim 1, wherein said pre-recorded word memory stores values of amplitude for words stored therein, said apparatus including means for determining and means for comparing the amplitude of each word.

5. The speech coder apparatus according to claim 1, further including quantizing means responsive to said output parameter signal to provide a quantized output signal and for coding said quantized output signal into one out of Y digital signals, where Y is the number of possible digital signals, whereby each word with a difference in parameter is coded into at least one out of Y digital signals for transmission over said channel.

6. The speech coder apparatus according to claim 1, wherein said low bit rate is about 50 bits per second.

7. The speech coder apparatus according to claim 1, wherein said first output signal has a maximum rate of about 27 bits per second with said second output signal having a rate of 21 bits per second.

8. A speech coder apparatus according to claim 1, including receiving means responsive to said first and second output signals as transmitted to provide at an output a synthesized speech signal, said receiving means including:

a synthesizer means responsive to said first and second output signals and having a pre-recorded word memory coupled to said synthesizer and having stored therein values of the pitch, duration and amplitude of a library of words as those words that can be recognized by said continuous speech recognition means, said synthesizer having means for processing said first and second output signals in conjunction with said values from said pre-recorded word memory to change the pitch, duration and amplitude of received words in said first output signal according to said second output signal.

9. The speech coder apparatus according to claim 1, including a synthesizer means, wherein said synthesizer means includes means for converting received speech signals via said first output signal into N sets of M signals with each signal including said output parameter signal, wherein N and M are positive integers greater than one.

10. The speech coder apparatus according to claim 9, wherein there are 240 (M) samples for each set of four sets (N) of coded excitation constitution one frame.

11. The speech coder apparatus according to claim 10, including pitch changing means for interpolating said N sets of M signals in said frame into a lesser number of samples in a first mode or a greater number of samples in a second mode.

12. The speech coder apparatus according to claim 10, wherein said set of samples includes 60 samples in a 7.5 millisecond interval, with four sets forming a 30 millisecond frame containing said 240 samples for each set.

13. The speech coder apparatus according to claim 12, wherein said values of pitch have a pitch frequency, and said pitch frequency is decreased by interpolating said 240 samples into 192 samples and wherein said pitch frequency is increased by interpolating said 240 samples into 288 samples.

14. The speech coder apparatus according to claim 9, including means for determining a long term delay for a frame, $_{T}$, and duration changing means, said duration changing means responsive to said second output signal and responsive to at least one set of said N sets of M signals to add or delete to said M signals, multiple sets of samples, each set of samples containing a number of samples which is the same as the number of the long term delay, $_{T}$ for the frame to increase or decrease the duration of a word.

15. The speech coder apparatus according to claim 14, further including means for changing the value of the amplitude of said samples by applying to said samples a synthesized gain factor.

16. The speech coder apparatus according to claim 14, including means for interpolating which includes a Lagrange interpolator operative to interpolate a frame of data into a different number of samples.

17. The speech coder apparatus according to claim 1, further including pitch slope changing means responsive to said pitch value to change said pitch value by a variable percentage from frame to frame.

18. A method for coding speech signals for providing compression of such speech signals to permit transmission of speech over a communication channel at bit rates of 100 per second or less, comprising the steps of:

comparing input speech with word templates stored in a memory to provide a coding indicative of recognized word data samples upon a favorable comparison;

transmitting said coding indicative of recognized word data samples over a first path;

simultaneously processing said input speech in a processor for each recognized word to provide an output parameter indicative of differences of values of pitch and duration data for each transmitted word with values of pitch and duration as stored in a memory associated therewith;

transmitting said output parameters indicative of said differences of values of pitch and duration data over a second path;

receiving said transmitted coding indicative of said recognized word data samples and said output parameters indicative of said differences of values of pitch and duration data;

synthesizing said received coding indicative of said recognized word data according to words stored in a library memory to provide a replication of said recognized word data; and using said transmitted output parameters indicative of said differences of values of pitch and duration data to change the pitch and duration data of said words as stored in said library memory to provide a synthesized pitch and duration for each word.

19. The method according to claim 18, wherein said step of comparing includes applying said input speech to a continuous speech recognition unit to match patterns in said input speech with templates stored in a memory using a dynamic time warping (DTW) algorithm.

20. The method according to claim 19, wherein said templates stored are speaker dependent and include words, filler and silence templates.

21. The method according to claim 20, further including the steps of:

analyzing said input speech to find word end points; and applying said word end points to said processor.

22. The method according to claim 21, further including the step of:

determining a parameter of amplitude for each word and transmitting said parameter prior to the step of synthesizing.

23. The method according to claim 18, wherein the step of changing pitch includes interpolating said recognized word data samples into a different number of data samples.

24. The method according to claim 23, wherein the step of changing duration includes inserting or deleting groups of samples into the recognized word data samples having a length equal to a given delay.

25. The method according to claim 23, wherein the step of interpolating employs the Lagrange interpolation form.

26. The method according to claim 25, wherein said step of synthesizing said received data includes:

converting said recognized word data samples into a linear predictive code for each word; and operating on said linear predictive code for each word to change the pitch and duration according to said transmitted median value of pitch and duration data.

27. The method according to claim 26, wherein the pitch of recognized data words has a slope, including the step of:

changing the slope of the pitch of recognized data words by varying the pitch by a variable percentage.

28. A speech coder apparatus for encoding input speech signals for transmission over a communication channel at low bit rates, comprising:

transmitting means responsive to an input speech signal for providing a first and a second output signal for transmission, said transmitting means including:

continuous speech recognition means having a first output and a second output, said continuous speech recognition means having a memory for storing templates and means responsive to said stored templates to provide, at said first output, digital signals indicative of recognized words in said input speech signal as those matching said stored templates, with said digital signals providing said first output signal, and providing, at said second output, a word end point signal wherein each of said recognized words in said input speech signal has a value of pitch, duration and amplitude;

front end processing means having an input and an output, said front end processing means responsive to said input speech signal for providing at said output of said front end processing means, digitized speech samples during a given frame interval including side information encoding means responsive to said digitized speech samples and capable of determining values of pitch, duration and amplitude, said side information encoding means having an input coupled to said second output of said continuous speech recognition means and operably responsive thereto, to provide at an output of said side information encoding means a signal indicative of at least the value of the pitch and duration for each word recognized by said continuous speech recognition means with said output of said side information encoding means includes means for comparing and determining differences of values of said pitch and duration of each recognized word with values of pitch and duration as stored in a memory associated therewith to provide an output parameter signal indicative of said differences; and receiving means responsive to said first and second output signals as transmitted to provide at an output a synthesized speech signal, said receiving means including:

a synthesizer means responsive to said first and second output signals and having a pre-recorded word memory coupled to said synthesizer and having stored therein values of the pitch, duration and amplitude of a library of words as those words that can be recognized by said continuous speech recognition means, said synthesizer having means for processing said first and second output signals in conjunction with said values from said pre-recorded word memory to change the pitch, duration and amplitude of received words in said first output signal according to said second output signal, wherein said synthesizer means includes means for converting received speech signals via said first output signal into N sets of M signals with each signal including said parameter signal, wherein N and M are positive integers greater than one, and wherein there are 240 (M) samples for each set of four sets (N) of coded excitation constituting one frame.

29. The speech coder apparatus according to claim 28, including pitch changing means for interpolating said N sets of M signals in said frame into a lesser number of samples in a first mode or a greater number of samples in a second mode.

30. The speech coder apparatus according to claim 28, wherein said set of samples includes 60 samples in a 7.5 millisecond interval, with four sets forming a 30 millisecond frame containing said 240 samples for each set.

31. The speech coder apparatus according to claim 30, wherein said values of pitch have a pitch frequency, and said pitch frequency is decreased by interpolating said 240 samples into 192 samples and wherein said pitch frequency is increased by interpolating said 240 samples into 288 samples.

32. A speech coder apparatus for encoding input speech signals for transmission over a communication channel at low bit rates, comprising:

transmitting means responsive to an input speech signal for providing a first and a second output signal for transmission, said transmitting means including:

continuous speech recognition means having a first output and a second output, said continuous speech recognition means having a memory of storing templates and means responsive to said stored templates to provide, at said first output, digital signals indicative of recognized words in said input speech signal as those matching said stored templates, with said digital signals providing said first output signal, and providing, at said second output, a word end point signal wherein each of said recognized words in said input speech signal has a value of pitch, duration and amplitude:

front end processing means having an input and an output, said front end processing means responsive to said input speech signal for providing at said output of said front end processing means, digitized speech samples during a given frame interval including side information encoding means responsive to said digitized speech samples and capable of determining values of pitch, duration and amplitude, said side information encoding means having an input coupled to said second output of said continuous speech recognition means and operably responsive thereto, to provide at an output of said side information encoding means a signal indicative of at least the value of the pitch and duration for each word recognized by said continuous speech recognition means with said output of said side information encoding means providing said second output signal for transmission and wherein said side information encoding means includes means for comparing and determining differences of values of said pitch and duration of each recognized word with values of pitch and duration as stored in a memory associated therewith to provide an output parameter signal indicative of said differences;

receiving means responsive to said first and second output signals as transmitted to provide at an output a synthesized speech signal, said receiving means including:

a synthesizer means responsive to said first and second output signals and having a pre-recorded word memory coupled to said synthesizer and having stored therein values of the pitch, duration and amplitude of a library of words as those words that can be recognized by said continuous speech recognition means, said synthesizer having means for processing said first and second output signals in conjunction with said values from said pre-recorded word memory to change the pitch, duration and amplitude of received words in said first output signal according to said second output signal, wherein said synthesizer means includes means for converting received speech signals via said first output signal into N sets of M signals with each signal including said parameter signal, wherein N and M are positive integers greater than one; and means for determining a long-term delay for a frame, $\tau$, and duration changing means, said duration changing means responsive to said second output signal and responsive to at least one set of N sets of M signals to add or delete to said M signals, multiple sets of samples, each set of samples containing a number of samples which is the same as the number of the long term delay, $\tau$ for the frame to increase or decrease the duration of a word.

33. The speech coder apparatus according to claim 32, further including means for changing the value of the amplitude of said samples by applying to said samples a synthesized gain factor.

34. The speech coder apparatus according to claim 32, including means for interpolating which includes a Lagrange interpolator operative to interpolate a frame of data into a different number of samples.

* * * * *

UNITED STATES PATENT AND TRADEMARK OFFICE

CERTIFICATE OF CORRECTION

PATENT NO. : 5,305,421

DATED : April 19, 1994

INVENTOR(S) : Kung-Pu Li

It is certified that error appears in the above-identified patent and that said Letters Patent is hereby corrected as shown below:

Column 9, line 19,

In Claim 1, Line 18 delete "works" and insert "words".

Signed and Sealed this

Second Day of August, 1994

*Attest:*

Bruce Lehman

BRUCE LEHMAN

*Attesting Officer*

*Commissioner of Patents and Trademarks*